US011794936B2

(12) United States Patent
Di Pinto et al.

(10) Patent No.: US 11,794,936 B2
(45) Date of Patent: Oct. 24, 2023

(54) LABELING MACHINE WITH LABEL APPLICATION SYSTEM FOR RECYCLING THE CONTAINER

(71) Applicant: Z-ITALIA S.R.L, Castellucchio (IT)

(72) Inventors: Ivan Di Pinto, Castellucchio (IT); Damiano Fabbri, Castellucchio (IT)

(73) Assignee: Z-ITALIA S.R.L., Castelluccio (IT)

( * ) Notice: Subject to any disclaimer, the term of this patent is extended or adjusted under 35 U.S.C. 154(b) by 0 days.

(21) Appl. No.: 17/419,478

(22) PCT Filed: Dec. 20, 2019

(86) PCT No.: PCT/IB2019/061216

§ 371 (c)(1),
(2) Date: Jun. 29, 2021

(87) PCT Pub. No.: WO2020/141396

PCT Pub. Date: Jul. 9, 2020

(65) Prior Publication Data

US 2022/0073229 A1 Mar. 10, 2022

(30) Foreign Application Priority Data

Dec. 31, 2018 (IT) ..... 102018000021526

(51) Int. Cl.

| | |
|---|---|
| ***B65C 9/18*** | (2006.01) |
| ***B65C 9/22*** | (2006.01) |
| ***B65C 9/26*** | (2006.01) |

(52) U.S. Cl.

CPC ..... *B65C 9/1819* (2013.01); *B65C 9/22* (2013.01); *B65C 9/26* (2013.01); *Y10T 156/1033* (2015.01)

(58) Field of Classification Search

CPC ..... B65C 9/1815; B65C 9/1819; B65C 3/06; B65C 3/08; B65C 3/16; B65C 3/163; B65C 9/20; B65C 9/22; B65C 9/26; B65C 2009/0071; Y10T 156/1033

See application file for complete search history.

(56) References Cited

U.S. PATENT DOCUMENTS

| | | | | |
|---|---|---|---|---|
| 5,116,452 | A | 5/1992 | Eder | |
| 6,238,509 | B1 | 5/2001 | Herlfterkamp et al. | |
| 6,347,657 | B1 * | 2/2002 | Bright | B65C 9/1819 271/276 |
| 2002/0007919 | A1 | 1/2002 | Cavaggioni | |
| 2014/0000803 | A1 * | 1/2014 | Carmichael | B65C 9/1819 156/60 |

FOREIGN PATENT DOCUMENTS

| | | | |
|---|---|---|---|
| DE | US6238509 | A1 | 1/1997 |
| DE | 19630690 | A1 | 2/1998 |
| DE | 102013215999 | A1 | 2/2015 |
| EP | 3115308 | A1 | 1/2017 |

* cited by examiner

*Primary Examiner* — Carson Gross

(74) *Attorney, Agent, or Firm* — CARMEL PATENT AGENCY; Robert J. Ballarini

(57) ABSTRACT

A labeling machine is presented for labeling containers by a continuous film strip suitably cut into labels, configured for fixing the label to the container by an adhesion fluid adapted to adhere the label to the container. The adhesion fluid is of the dissolvable type within a determined time sufficient to guarantee the function of applying the label to the container and/or removable through the use of suitable removal means.

10 Claims, 10 Drawing Sheets

LABELING MACHINE WITH LABEL APPLICATION SYSTEM FOR RECYCLING THE CONTAINER

INVENTIVE FIELD

The present invention is part of the field of labeling systems or labeling machines with particular regard to the application of the plastic or paper label on a container, so as to optimize and facilitate the recovery of glass or plastic bottles or containers for use subsequent to the first one.

BACKGROUND

In the case of bottles with labels, they are uncapped and delabeled or those screen-printed without labels are simply uncapped.

Once the cap and label have been removed, they are washed, filled, recapped and labeled again or alternatively they are washed, empty labeled, filled, recapped.

The bottles to be processed are for example those for beer, water or soft drinks, in particular glass or plastic bottle with wrapping label.

The labeling methods within which the invention falls relate to the one called Roll Fed.

Currently, this is the most sought-after among the labeling systems due to economy and aesthetics.

Roll Fed labeling involves using a continuous film reel to label plastic, metal or glass containers. In this case the film is respectively unrolled, cut and applied to the container.

The state of the art provides that the system for fixing the label on the container can be made in different ways; one of the most used one involves applying the label using glue which may already be present on the reel or applied after cutting the same label, and then transferring it by means of drum devices on the containers.

If the glue is applied after cutting the label, the glue can be distributed on the initial and final flap of the label by means of a spray system, without contact, or by means of a roller system that comes into contact with the projections of a drum on which the label is conveyed, so that the glue is on the two extreme flaps of the label and over their entire height. Said drum will then adhere the label to the bottle.

The label thus created has two strips of glue, one for fixing a first flap of the label to the bottle and one for fixing a second flap on the portion of the label on which the overlap superimposes, after the label has been completely wrapped around the bottle over a whole cylindrical portion thereof.

The use of normal hot-melt glue entails the drawback that the label is not easily detachable from the bottle, and makes the recycling of the container more problematic also because the bottle might remain contaminated by the glue.

SUMMARY

The technical problem underpinning the present invention is that of making available a labeling machine for applying a label to articles structurally and functionally designed to overcome one or more of the limits set forth above with reference to the known prior art.

In the context of the aforesaid problem, a main object of the invention is to develop a labeling machine, which allows obtaining a labeling which simplifies the recycling of the container.

A further object of the invention is also to make available to the art a labeling machine in the context of a reliable solution, and with high rate.

These and other objects are reached by the characteristics of the invention as set forth in the independent claims. The dependent claims outline preferred and/or particularly advantageous aspects of the invention.

In particular, an embodiment of the present invention makes available a labeling machine for labeling containers by means of a continuous film strip suitably cut into labels, configured for fixing the label to the container by means of an adhesion fluid adapted to adhere the label to the container, in which said adhesion fluid is of the dissolvable type within a given time sufficient to guarantee the function of applying the label to the container and/or removable through the use of suitable removal means.

Preferably the adhesion fluid comprises, or consists of water, or alternatively a degradable glue or a fluid with low-adhesive components.

Thanks to this solution, the detachment of the label from the container is simple and facilitates recycling.

An object of the present invention is also to allow a good label application reliability.

In fact, the labeling machine can comprise means for adhering the label to the container comprising fluid distribution means for distributing said adhesion fluid.

Furthermore, the adhesion means can comprise application means adapted to guide said label so as to dispose it at or near the surface of said container one towards the other, operating along substantially the entire extension of the area in which the respective faces of said label and the body of said container are mutually facing.

Thanks to this solution it is possible to label ensuring a better precision of positioning of the label on the container.

Further the invention makes available a labeling machine, wherein the application means comprise a transfer drum, rotating around an axis, which provides at least one application area configured to retain the label and apply it to the container, said application area in turn comprises a label guide profile on which the label conforms so as to keep a distance between the container and the label guide profile substantially constant throughout the application cycle.

Being able to maintain the distance between the container and the label guide profile constant and preferably at a few, it is possible to position the label precisely even in the absence of a glue that guarantees the adhesion thereof to the container.

Furthermore, this precision allows the label to be closed on the overlap without the glue for closing the overlap, generally of the hot-melt type, ending up on the container due to a too short overlap.

An object of the present invention is also to provide a treatment method for recycling the labeled container, which provides for the washing of the container using liquid, preferably water suitable for deactivating the adhesion fluid for detaching the label from the container.

BRIEF DESCRIPTION OF THE DRAWINGS

This and other features will be more apparent from the following description of some of the embodiments, illustrated purely by way of non-limiting example in the accompanying drawings.

DETAILED DESCRIPTION OF THE PREFERRED EMBODIMENTS

Figure 1:
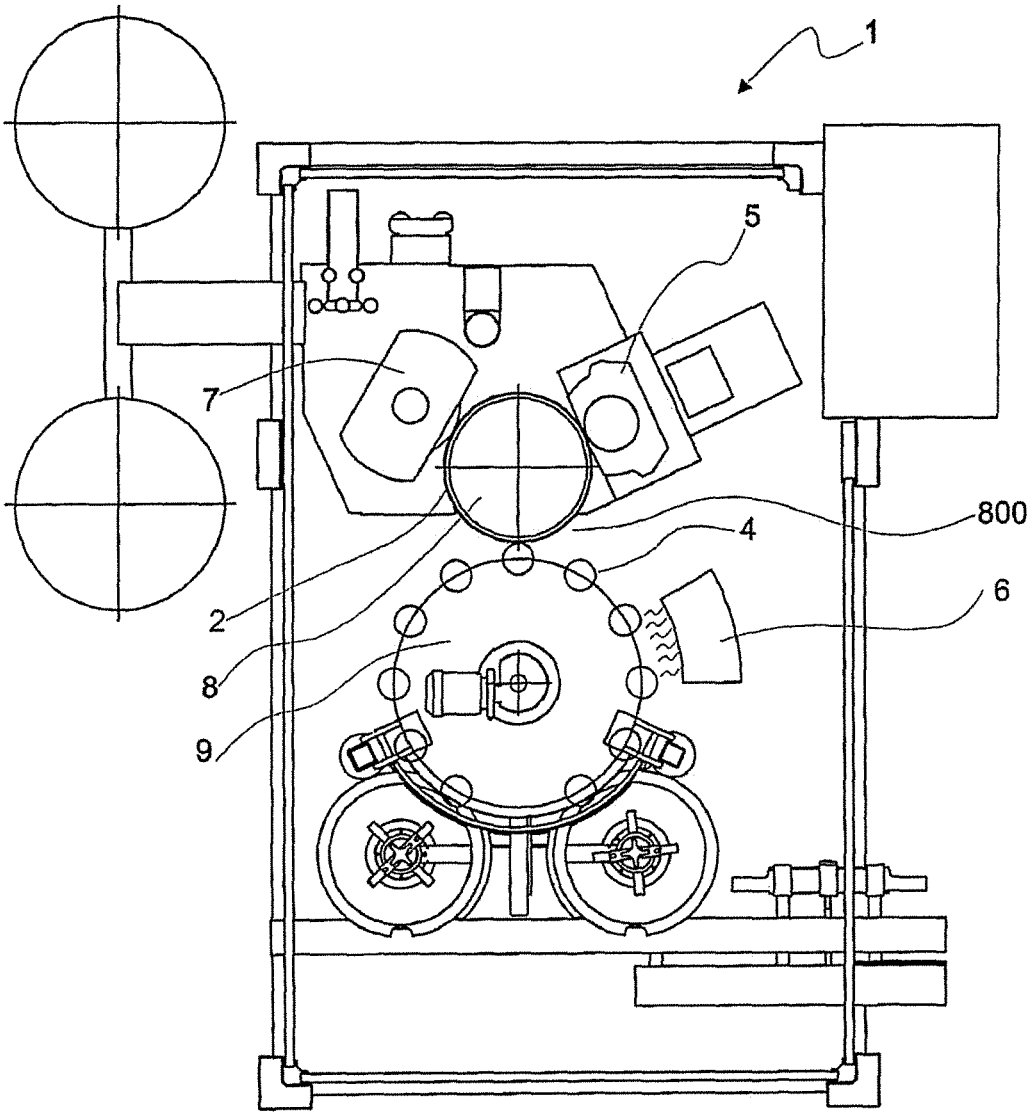
FIG. 1: illustrates a schematic plan view of a water labeling machine, according to the invention.
Figure 2A:
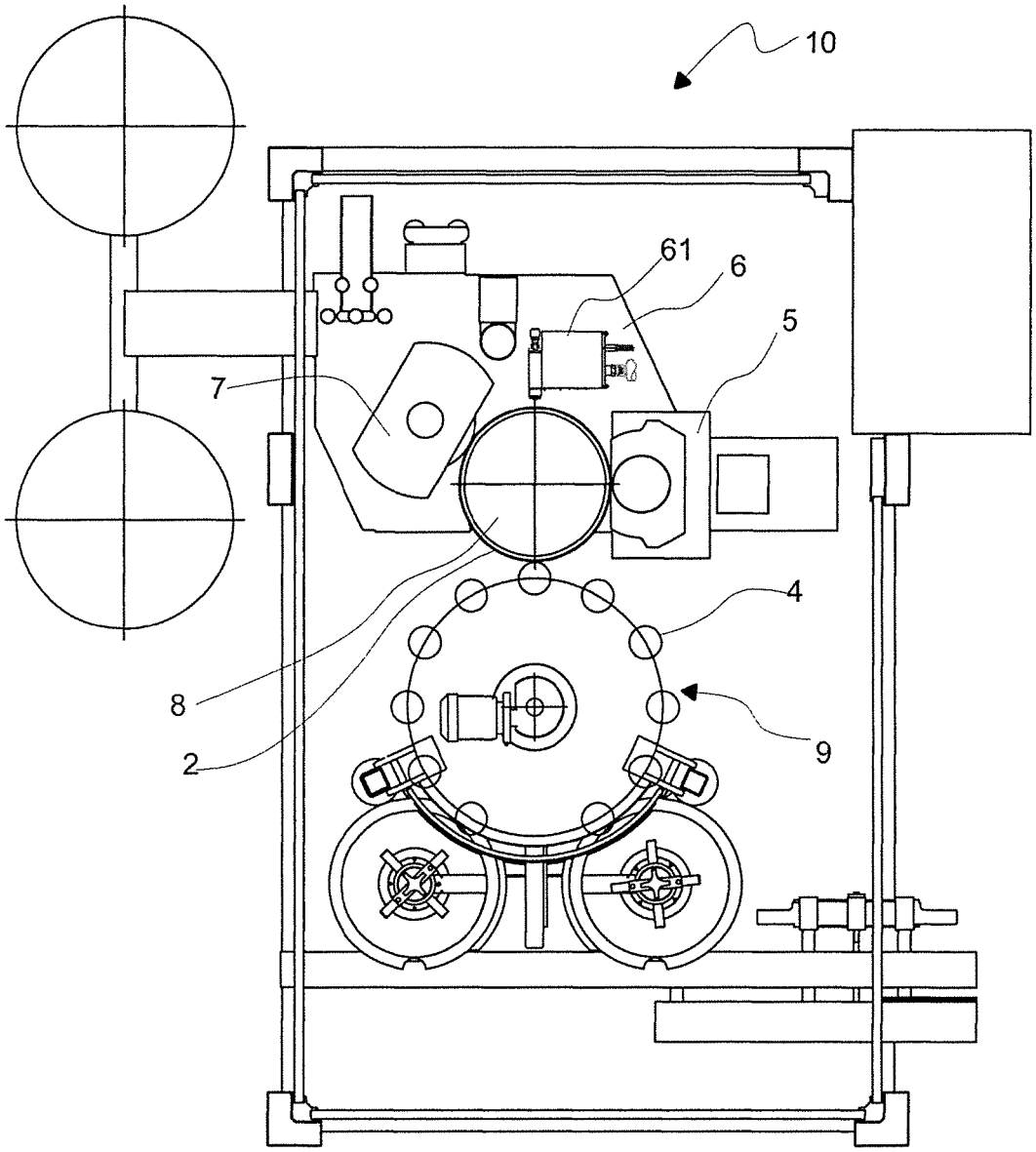
FIG. 2*a*: illustrates a schematic plan view of a labeling machine with degradable glue in a first embodiment
Figure 2B:
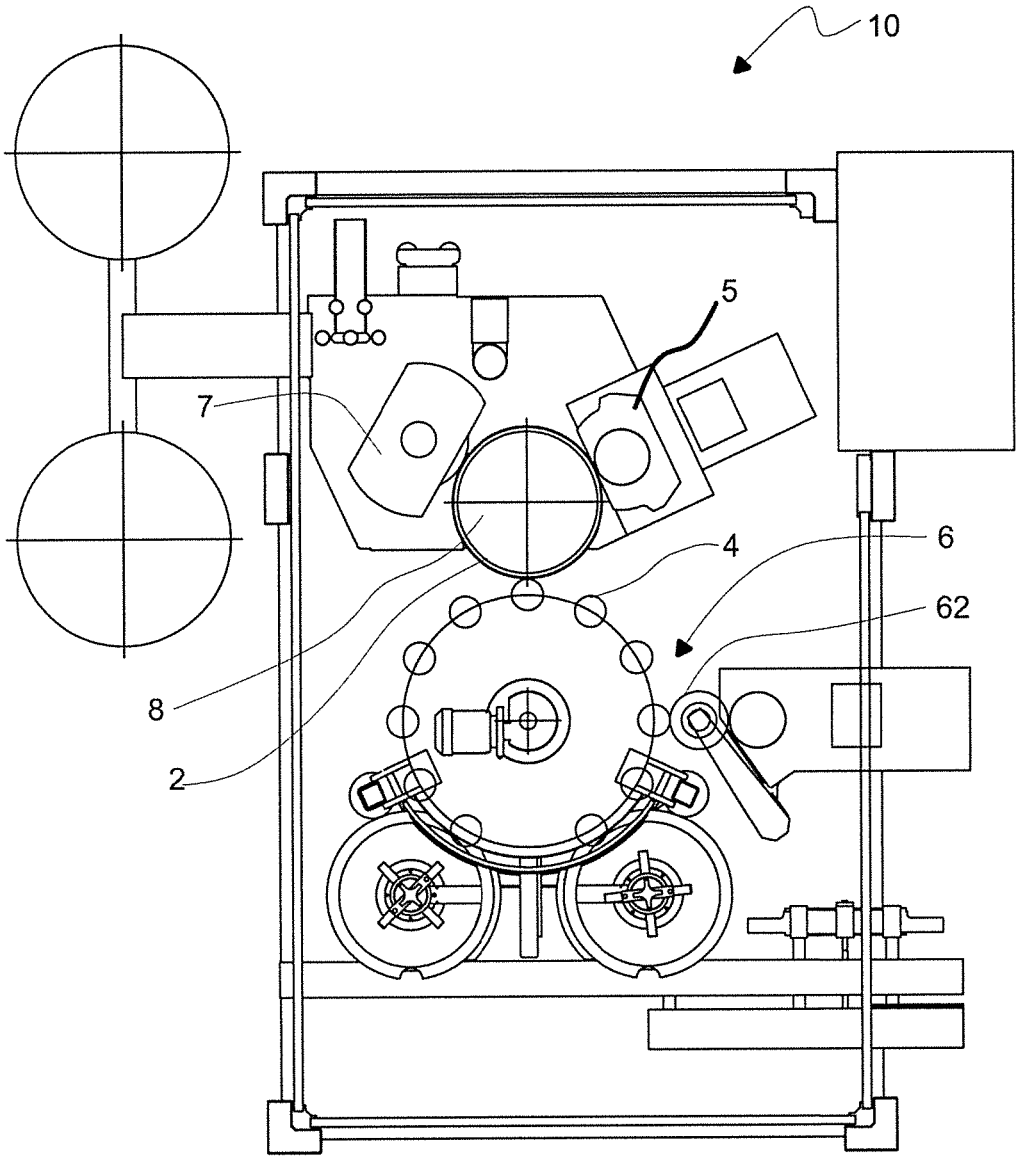
FIG. 2*b*: illustrates a schematic plan view of a labeling machine with degradable glue in a second embodiment

With particular reference to FIGS. 1, 2*a* and 2*b*, possible embodiments of a labeling machine or a labeling device according to the invention are shown.

Below we will use the term container and bottle, but also more generally articles, as synonyms.

Figure 7:
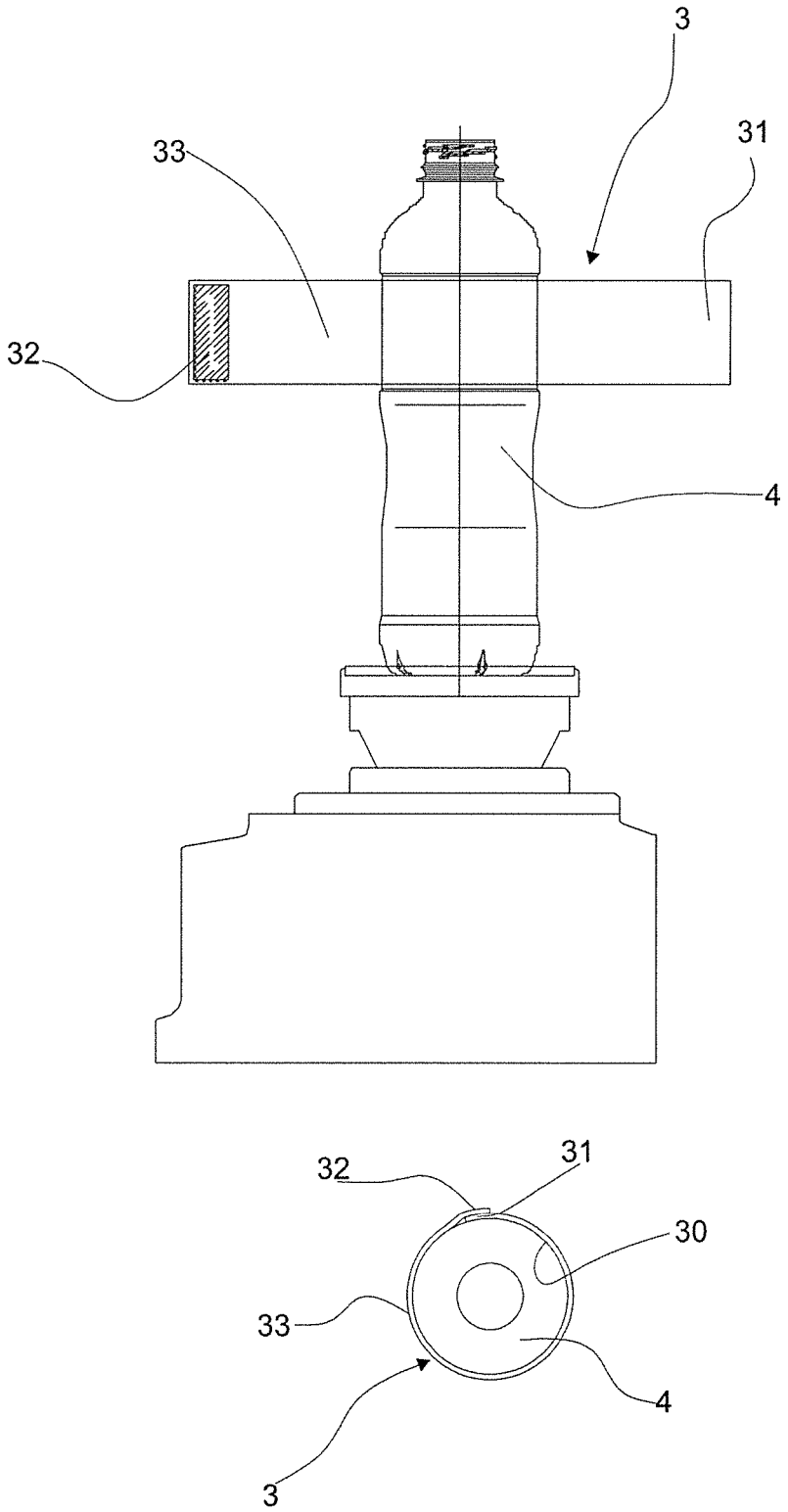
FIG. 7: illustrates an elevation and plan view of a container with label.

For simplicity's sake of description, as illustrated in FIG. 7, we divide the length of the label into a final flap 32, an initial flap 31 and a central portion 33 of the label 3; initial flap 31 means the flap of the label 3 which first comes into contact with the container 4 during application, while the final flap 32 means the flap which lastly comes into contact with the container 4 during application.

As shown in FIG. 7, the labeling preferably provides for the final flap 32 of the label 3 to be superimposed and fixed to the initial flap 31, that is, the label 3 is closed and fixed on the overlap; the fixing can be carried out for example by means of a fixing device 5 for the application of a glue on the final flap 32 of the label 3.

The technician of the sector with the term overlap refers to the superimposing of the final flap 32 on the initial flap 31 of the label 3.

We describe below the known art relating to glue labeling machines, generally hot-melt, to better clarify the differences with the invention. The known labeling machine generally comprises a transfer drum 8*a* configured for advancing the film 2 and advancing means for moving the container 4.

During the application step, it is provided for distributing the hot-melt glue on the initial and final flap of the label 3 by means of a spray system, without contact, or by means of a roller system which comes into contact with the projections of the transfer drum 8*a* on which the label 3 is conveyed, so that the glue is on the two extreme flaps of the label 3 and over their entire height.

Then the transfer drum 8*a* transfers the cut label 3 to the container 4.

Figure 6:
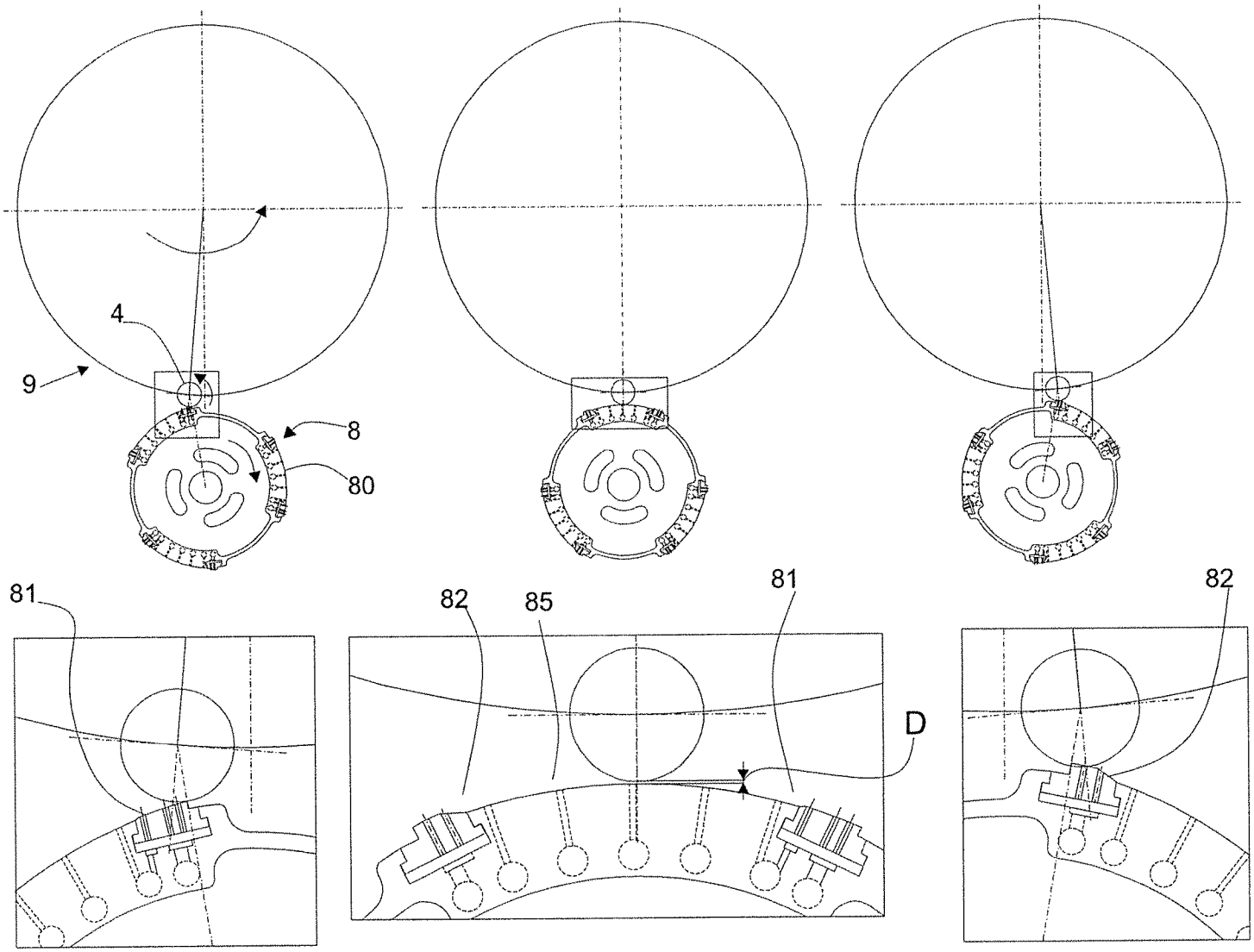
FIG. 6: illustrates a plan view of the steps for applying the label by means of a drum conformed according to the invention.
Figure 6A:
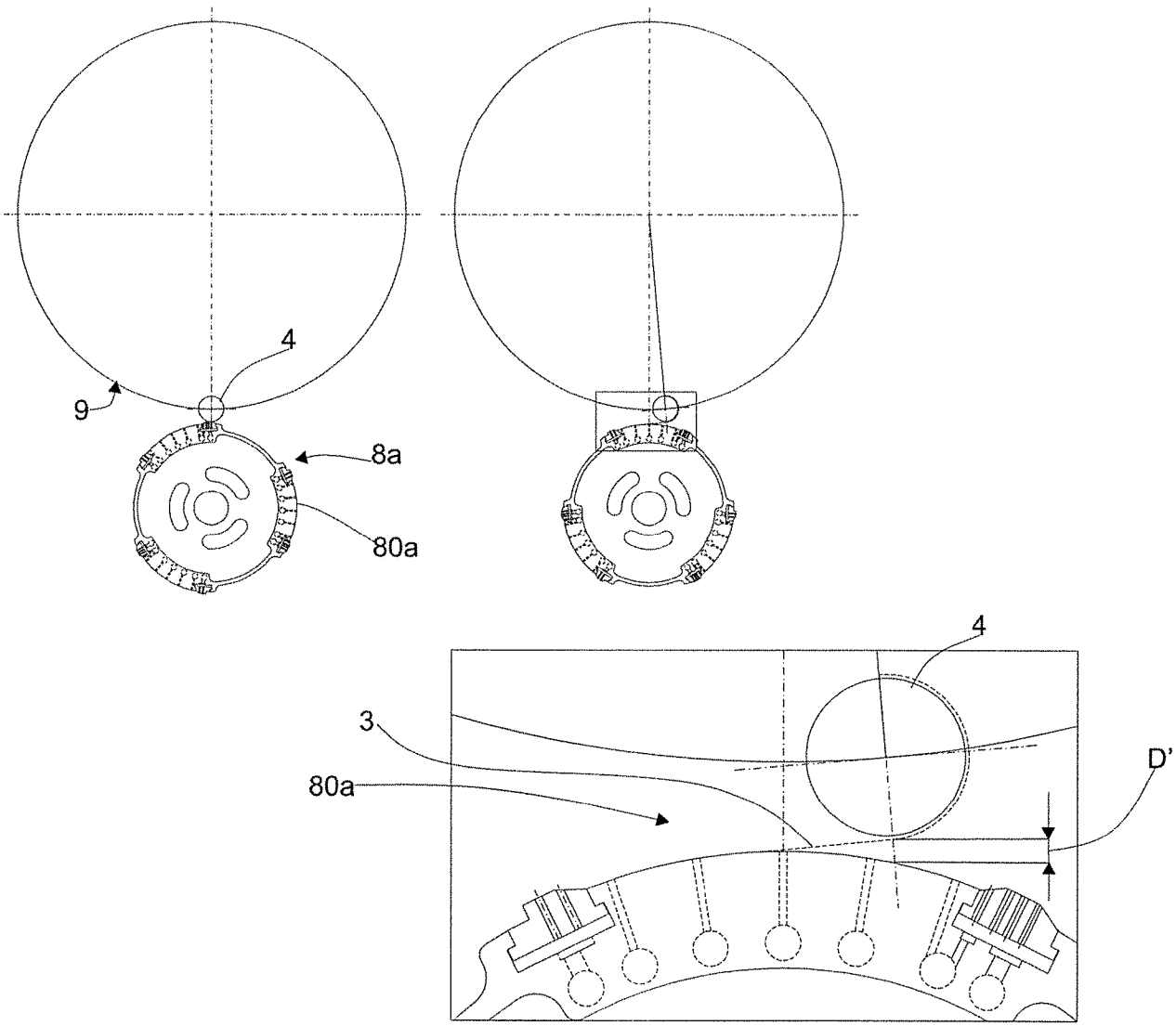
FIG. 6*a*: illustrates a plan view of the steps for applying the label in a flag-like manner by means of a drum conformed like a cylindrical roller.

The known glue labeling machines provide that the transfer drum 8*a* is cylindrical in shape, which for simplicity's sake will be called below the cylindrical transfer drum 8*a*, used by means of the labeling cycle, which in the technical jargon is also defined as flag-like as shown in FIG. 6*a*.

Figure 3:
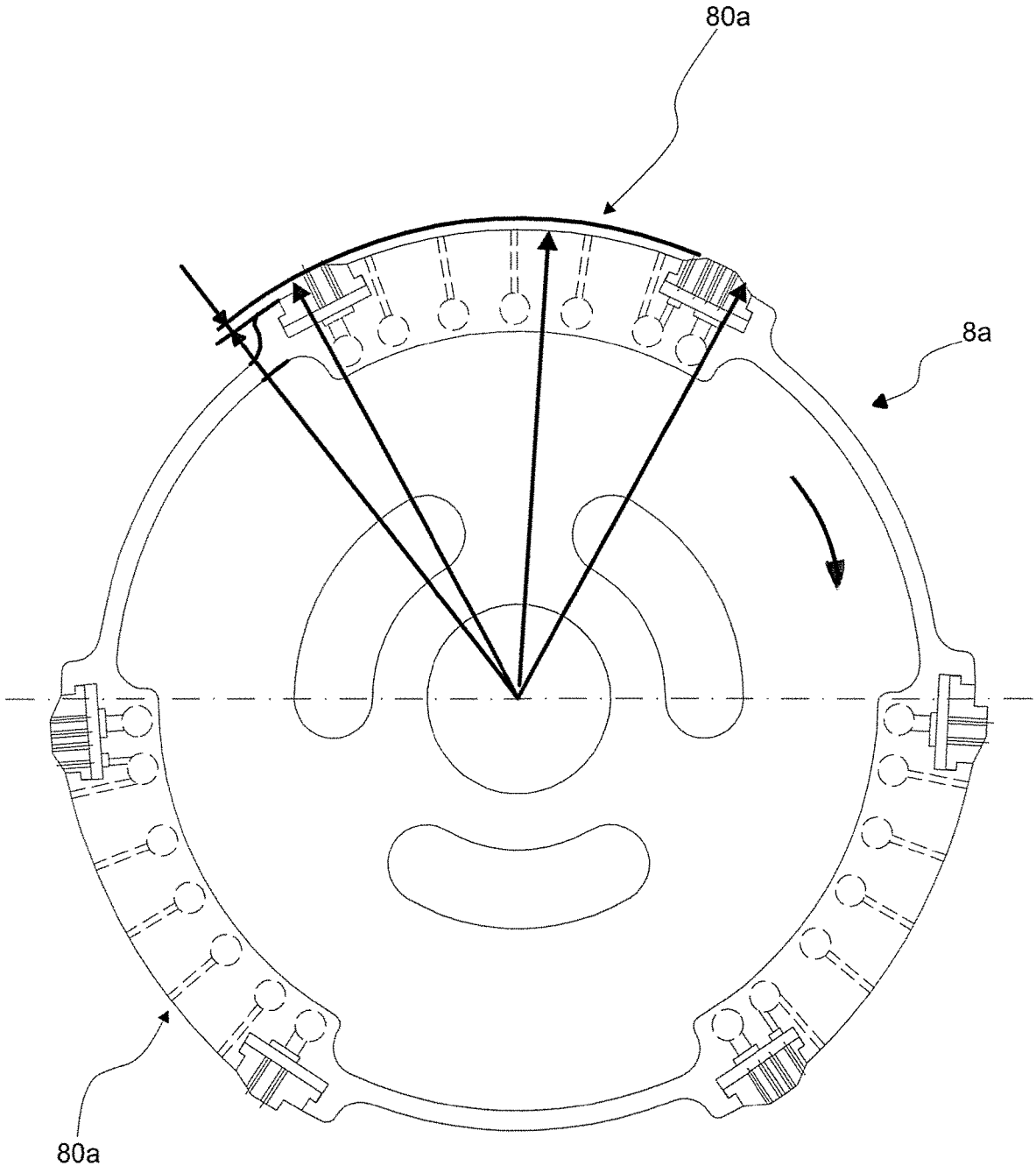
FIG. 3: illustrates a plan view of a cylindrical drum for applying the label, according to the prior art.

The cylindrical transfer drum 8*a*, as shown in FIG. 3 comprises at least one application area 80*a* configured to retain the label 3 and transfer it to the container 4 during application.

This labeling cycle in a flag-like manner, as shown in FIG. 6*a*, provides for the label 3 to be pressed onto the container 4 only in its initial flap 31; the remaining part of the label 3, arranged in a flag-like manner, is wrapped only by rotation of the container 4. When closing the overlap nothing can guarantee that the label 3 is correctly wrapped until it is precisely superimposed on the overlap.

The cylindrical shape of the cylindrical transfer drum 8*a* implies that during the application of the label 3 there is a variable distance D' between the container 4 and the application area 80*a*; said distance D' is therefore high and such as not to guarantee that the label 3 which is positioned in a flag-like manner is held in position.

Generally, known glue labeling machines use said cylindrical transfer drum 8*a*, followed by a device for example with brushes which presses the label 3 on the container 4 so as to guarantee the adhesion thereof and the correct wrapping around the container 4.

The object of the present invention relates to a labeling machine 1 and 10 for applying a label 3 to articles in particular containers 4 where said label 3 preferably consists of plastic film and in particular suitably cut from a preferably continuous film strip 2. In particular it can be a labeling machine 1, 10 of the Roll Feed type.

As will be better described below, two preferred embodiments of labeling machine 1 and 10 are provided for.

FIG. 1 shows a labeling machine 1 according to a first embodiment of the invention; instead, FIGS. 2*a* and 2*b* show a labeling machine 10 according to a second embodiment of the invention.

In accordance with an aspect of the invention, the labeling machine 1, 10 is configured for fixing the label 3 to the container 4 by means of an adhesion fluid adapted to adhere the label 3 to the container 4, characterized in that said adhesion fluid is of the dissolvable type within a given time sufficient to guarantee the function of applying the label 3 to the container 4 and/or removable through the use of suitable removal means.

Therefore said fluid is such that over time it dissolves or deteriorates, thereby losing its adhesive properties and/or this dissolution step is aided by suitable removal means, for example by washing the labeled container 4, during the recycling step.

In particular, one embodiment provides that the adhesion fluid comprises, or consists of water. Water is in fact a fluid that dissolves by evaporation.

A further embodiment provides that the adhesion fluid comprises, or consists of, a degradable type glue.

The term degradable glue means a fluid that maintains its adhesive properties for a fairly short period of time, for example compatible with the sole function of applying the label 3 to the container 4.

In fact, it is sufficient that it exerts its action only for the time necessary to create the tube of the label 3 around the container 4 during application.

Alternatively, it is intended a glue in which the adhesive components are subject to natural ageing, which attenuates their sealing characteristics, until they are completely exhausted, in particular over the duration of use of the container 4.

According to a different alternative embodiment, the degradable adhesion fluid could be an adhesion fluid which can be deactivated following an appropriate treatment, for example following a washing step of the container 4, in particular with water.

An example of degradable glue can be given by the presence of substances such as dextrins in the fluid.

Still it can further be provided that the adhesion fluid comprises, or consists of, and/or a fluid with low-adhesive components.

The term fluid with low-adhesive components means a fluid that has a very low adhesion, therefore comparable to water sufficient to create a temporary adhesion during the application step of the label 3 to the container 4 capable of subsequently dissolving/degrading or to be easily removed.

Once the label 3 has been applied to the container 4, in the event that the adhesion fluid is of the water type, the label 3 results to be as a tube free to rotate around the surface of the bottle 4 since it is not directly fixed thereto, especially following water evaporation.

In the event that the adhesion fluid is a degradable glue, or fluid with low-adhesive components, the label 3 will result to be as a tube that is free to rotate around the surface of the bottle 4, when the degradation, removal or dissolving phase has been completed.

Therefore, during the recycling step of the containers 4, it is easy to remove the label 3 and the container 4 is clean, i.e. not contaminated with glue.

In a formulation of the present invention the labeling machine 1, 10 comprises means for adhering the label 3 to the container 4 in turn comprising fluid distribution means 6 for distributing said adhesion fluid.

In particular, the first embodiment provides for a labeling machine 1, preferably configured to work with adhesion fluid of the water type and/or fluid with low-adhesive components.

Said labeling machine 1 preferably comprises distribution means for distributing adhesion fluid 6, configured to distribute said adhesion fluid on the container 4 body and/or on a corresponding face 30 of the label 3 along substantially the whole application surface in order to make the label 3 adhere to the container 4.

In order to help with applying the label 3 by water it is not possible to use the brush device known for glue labeling machines since, being the adhesive power of the water low, the brushes would tend to detach the label 3 from the container 4 by moving it from the correct position.

Therefore, according to a possible configuration, the adhesion means in the machine 1 can further comprise application means 800 adapted to guide said label 3 so as to dispose it at or near the surface of said container 4 one towards the other, operating along substantially the entire extension of the area in which the respective faces 30 of said label 3 and the body of said container 4 are mutually facing.

Said labeling machine 1 therefore combines adhesion means for the purpose of applying the label 3 to the container 4; in particular it combines the use of distribution means 6 for distributing an adhesion fluid, with the use of application means 800 adapted to guide and hold/push said label 3 in position on the container 4 during the application step.

Thanks to this solution, precise and reliable labeling is obtained.

The second embodiment provides that the labeling machine 10 for labeling containers 4 by means of a continuous film strip 2 suitably cut into labels 3, is configured for fixing the label 3 to the container 4 by means of an adhesion fluid adapted to adhere the label 3 to the container 4; said adhesion fluid comprises, or consists of, a degradable type glue adapted to maintain its adhesive properties within a given time sufficient at least to guarantee the function of applying the label 3 to the container 4.

In fact, the use of a degradable type glue allows a secure adhesion of the label 3 to the container 4 and allows reaching high labeling rates that cannot be achieved with water labeling, since the temporary adhesion achieved with water is so not strong and it therefore requires a slower application cycle.

In accordance with a feature of the present invention, said labeling machine 10 can provide for adhesion means which comprise fluid distribution means 6 for distributing said adhesion fluid on the initial flap 31 of the label 3.

In particular, the glue will be placed on the label 3 in a position that is non-interfering with a second glue for fixing the overlap.

Said fluid distribution means 6 are preferably of the dispensing gun type 61 configured to spray the glue on the label 3 as shown in FIG. 2*a*.

The glue is sprayed when the label advances retained on the transfer drum 8.

As shown in FIG. 2*a*, said gun 61 is positioned between a cutting device 7 and a fixing device 5.

The fixing device 5 is configured for fixing the overlap, generally by means of hot-melt glue.

The dispensing gun 61 has the advantage of having reduced dimensions and therefore can be installed on the labeling station.

It is understood, however, that what is described above has an exemplifying and non-limiting value and also a different position of the fixing device 6, which becomes necessary for technical and/or functional reasons, is now considered to be within the same protective scope.

Alternatively, the labeling machine 10 can provide for adhesion means, which comprise fluid distribution means 6 configured to distribute said adhesion fluid over a portion of container 4 adapted to receive the label 3.

Said portion of the container 4 preferably corresponds to the area adapted to receive the label 3 and it further preferably corresponds to the application area of the initial flap 31 of the label 3. It may also be envisaged to distribute the glue on the central portion 33. In this way the glue is not distributed on the label 3, but directly on the container 4.

Said fluid distribution means 6 are preferably of the dispensing roller type 62 for spreading the glue on the container 4 as shown in FIG. 2*b*.

Therefore the labeling machine 10 can provide for distribution means 6 to be configured so as to cooperate with the advancing means 9 for applying the glue on the container 4.

The distribution means 6 and the advancing means 9 of the container 4 will be suitably synchronized by means of the programmable control unit which manages the machine 1.

Thanks to this solution, it is possible to maintain reduced dimensions of the transfer drum 8 around which at least the cutting device 7 and the fixing device 5 will be arranged, in addition to the label application area 3, which interfaces with the advancing means 9.

According to an aspect of the invention, said labeling machine 10 can provide for applying the label 3 by means known to a person skilled in the art and already used in known glue labeling machines, such as for example cylindrical transfer drum 8*a*, often followed by a device for example with brushes adapted to press the label 3 on the container 4 so as to guarantee its adhesion and correct wrapping around the container 4.

An object of the present invention is also to allow an optimization of the application of the label 3 and therefore a preferred embodiment of the labeling machine 10 provides that the means for the further adhesion comprise application means 800 adapted to guide said label 3 so as to dispose it at or near the surface of said container 4 one towards the other, or vice versa, operating along substantially the entire extension of the area in which the respective faces 30 of said label 3 and the body of said container 4 are mutually facing.

In a formulation of the present invention, in both labeling machines 1 and 10, said application means 800 can preferably comprise a transfer drum 8 having particular constructional characteristics which will be described in detail below.

Said labeling machine 1 and 10 differs from the known labeling machines by the presence of a transfer drum 8 having a different conformation from the cylindrical drum 8*a*.

In fact, especially in machines 1, in which the adhesion fluid is water and/or fluid with low-adhesive components, the combination of low adhesion and the use of a cylindrical transfer drum 8*a* in which the distance D' between the application area 80*a* and the container 4 is variable and high, does not allow the label 3 to be accompanied to the position around the container 4 during application.

In accordance with the aforementioned purposes, the transfer drum 8, according to the invention, configured to advance the film 2, is synchronized with the advancing means 9 of the container 4 by means of a programmable control unit.

Figure 6B:
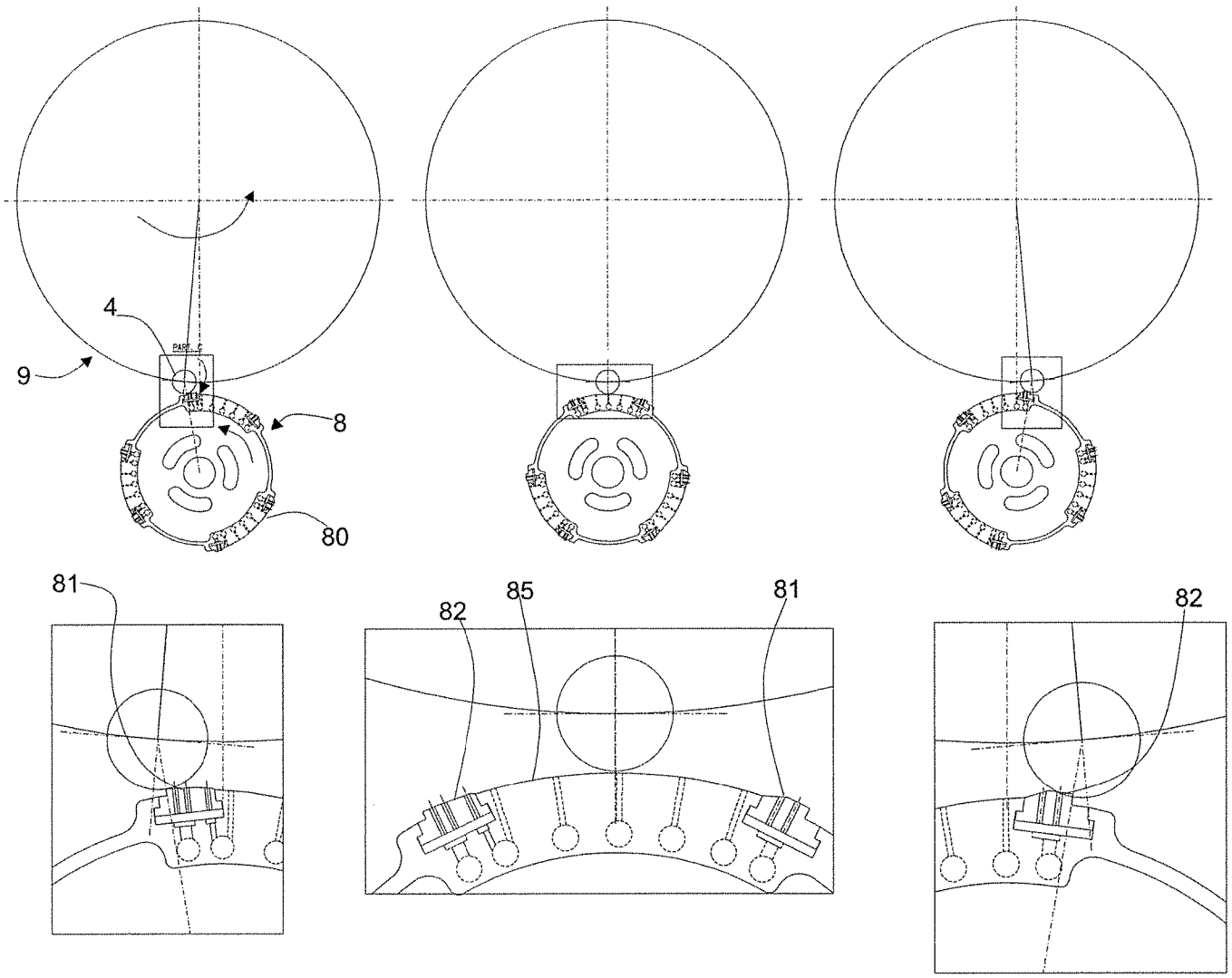
FIG. 6*b*: illustrates a plan view of the steps for applying the label by means of a drum conformed according to the invention with labeling in negative direction.

The labeling can take place in a positive direction, as shown in FIG. 6, or in a negative one, as shown in FIG. 6*b*, where positive means that if the advancing means 9 rotate for example in a clockwise direction, the drum 8 rotates in the opposite direction and therefore anticlockwise; labeling in a negative direction, also called in counter speed, means instead that if the advancing means 9 rotate, for example, clockwise, the drum 8 also rotates clockwise. In this second case, shown in FIG. 6*b*, the transfer drum 8 will be the same, but mirrored with respect to that used in the operation in a positive direction.

Said transfer drum 8 is also configured to cooperate with a cutting device 7 for cutting the film 2 into labels 3.

Once the label 3 has been cut, the transfer drum 8 being configured to rotate around an axis Z thereof, carries the label 3 at the container 4 on which it must be applied. The container 4, moved by the advancing means 9, arrives near the transfer drum 8.

As shown in FIGS. 1*a*, 2*a* and 2*b*, the transfer drum 8 is further configured to cooperate with a fixing device 5 configured for fixing the final flap 32 on the initial flap 31 of the label 3, that is, for fixing the overlap.

Said fixing device 5 is preferably configured for the application of a glue on the label 3.

The fixing device 5 applies the glue generally of the hot-melt type, therefore of the non-degradable type, with the aim of fixing the overlap.

According to an aspect of the invention, the transfer drum 8 comprises at least one application area 80 configured to retain and transfer the label 3 by interfacing with the container 4 during the application of the label 3.

The transfer drum 8 can provides for several application areas 80 depending on the size of the advancing means 9, on the number of sections of the carousel supporting the containers 4.

Said application area 80 preferably comprises a label guide profile 85.

A possible embodiment provides that the application area 80 further comprises, at an initial flap 31 and a final flap 32 of the label 3, respectively, that is at the first point of application of the label 3 to the container 4 and at the overlap point, an initial shoe 81 and a final shoe 82, adapted to guarantee respectively the application to the container 4 and the closure of the label 3 on the overlap.

Said shoes 81, 82 are preferably made of deformable material, for example rubber.

A preferred embodiment provides that said shoes 81, 82 are protruding from the label guide profile 85 which is in fact included between said initial shoe 81 and final shoe 82. The protrusion of said shoes 81, 82 defines an offset H from the label guide profile 85 which is preferably variable and different between the initial shoe 81 and the final shoe 82, such as to make them interfere with the container 4 by exerting the right pressure for positioning the first flap 31 of the label 3 to the container 4 and for closing the second flap 32.

Said transfer drum 8 provides that the label guide profile 85 does not extend according to a circumference having a radius of curvature centered on the rotation axis Z, as is the case for the cylindrical transfer drum 8*a*.

Said label guide profile 85 in fact has a conformation such as to maintain substantially constant and minimum a distance D between said label guide profile 85 of the transfer drum 8 and the container 4 throughout the whole application cycle of the label 3. Therefore the label 3 is not placed in a flag-like manner, but the transfer drum 8 exerts an action aimed at guiding and holding the label 3 in position throughout the application cycle on the container 4.

According to a preferred embodiment, said distance D is a few millimeters and preferably less than 2 millimeters.

In order to keep said distance D minimal and constant, it is further provided for the transfer drum 8 and the advancing means 9 of the container 4 to be synchronized throughout the application cycle of the label 3.

The use of said transfer drum 8 as conformed, allows overcoming the limits that are found with the cylindrical drum 8*a*.

In fact the distance D, which remains substantially constant and of a few millimeters during the whole application cycle, makes it possible to guarantee that the label 3 is wrapped in the correct position during its application to the container 4 allowing to increase the precision of the superimposition of the overlap for closing the second flap 32 on the first flap 31 of the label 3, without the hot-melt glue of the overlap ending up on the bottle due to a too short overlap. Therefore the reliability of the labeling machine 1, and/or 10 is increased.

In fact, this minimum and constant distance D between the label guide profile 85 and the container 4 guides and pushes the label 3 into position and allows its wrapping in a tube-like manner around the container 4, even when the adhesion force of water is minimal or when for example the label 3 is very low and therefore with a reduced contact surface with the container 4.

FIG. 6 shows the relative positions of the container 4 on the advancing means 9 and of the transfer drum 8 during the application steps of the label 3.

FIG. 6 highlights the effect of accompanying, guiding and retaining in position of the label 3 that the transfer drum 8 exerts.

In fact, FIG. 6 shows the labeling steps, in which the first application point of the label 3 and the last point in which the overlap is glued, are preferably symmetrical with respect to an axis A which connects the center of the advancing means 9 and the center of the transfer drum 8.

FIG. 6 shows the distance D between the container 4 and the label guide profile 85 which remains substantially constant both near to said axis A and not.

On the contrary, FIG. 6*a* shows the relative positions of the container 4, on the advancing means 9, and of the cylindrical transfer drum 8*a*, in which the missing effect of accompanying guiding and retaining in position of the label 3 is highlighted.

A preferred embodiment of the transfer drum 8, also defined lobed label guide profile 85 and with a lobed initial shoe 81, can comprise different radii of curvature:

- a first radius R1 having center C1 preferably on the rotation axis Z of the transfer drum 8,
- a second radius R2 having center C2 which is not placed on the rotation axis Z and therefore it is not coincident with C1
- preferably a third radius R3 having center C3 not coinciding with C1 and C2.

Figure 4:
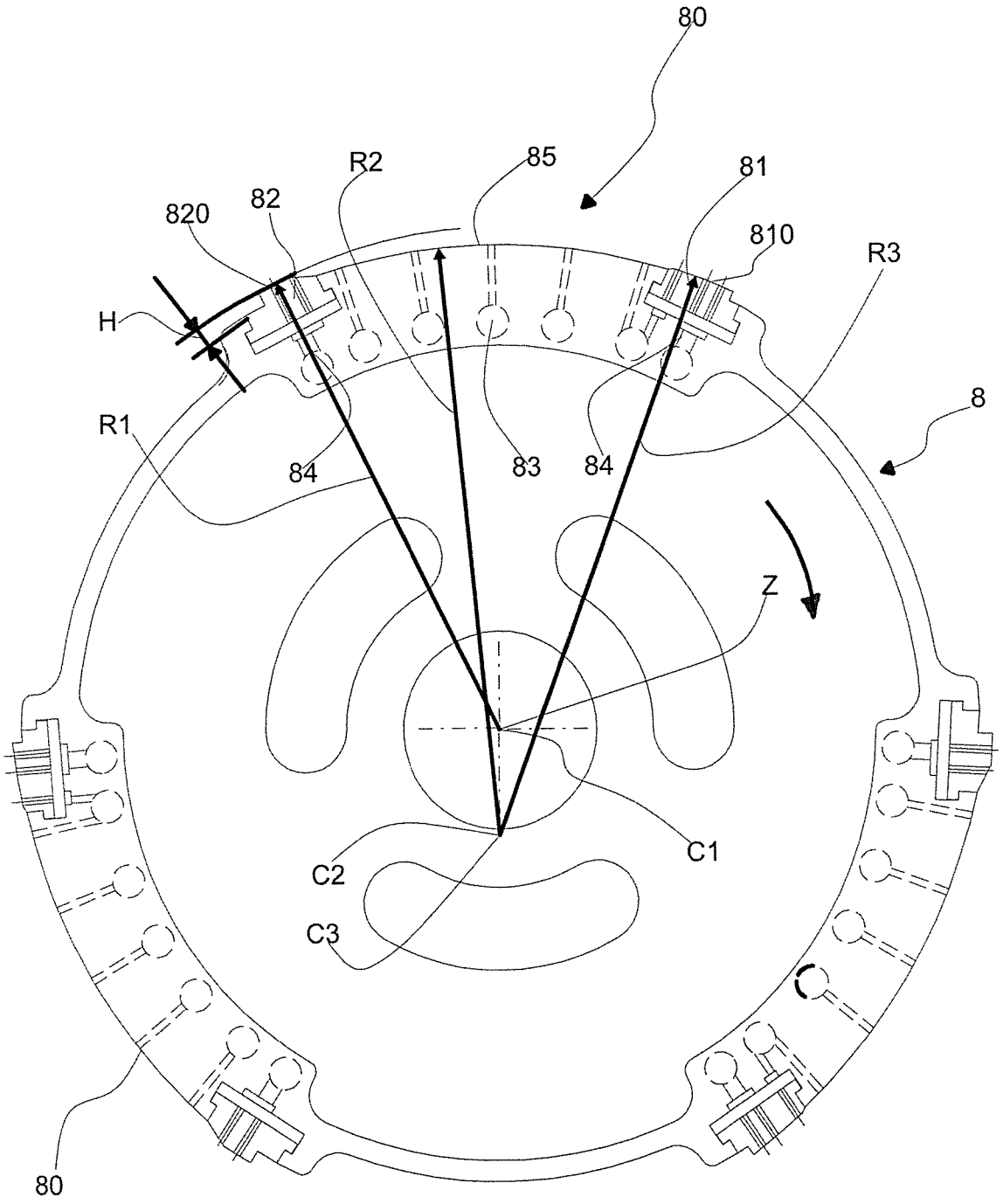
FIG. 4: illustrates a plan view of a drum for applying the label according to the invention.
Figure 5:
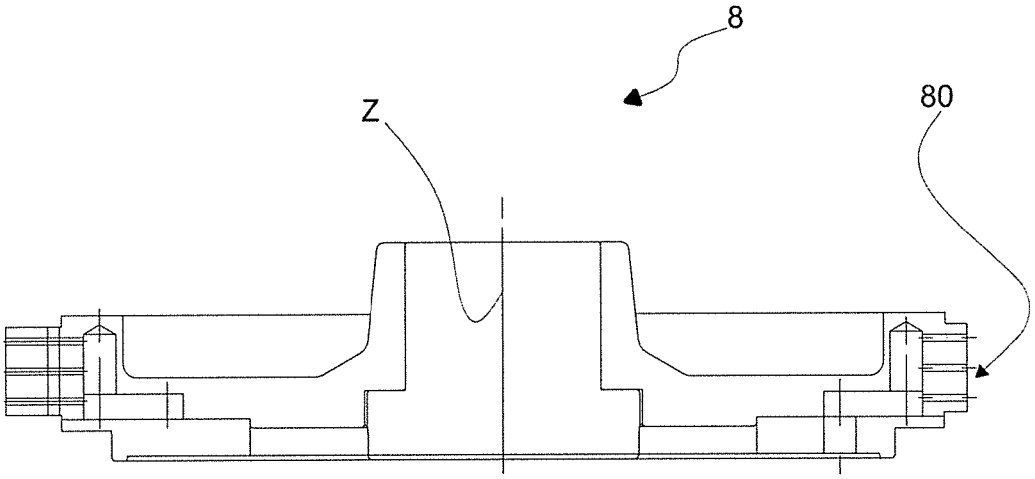
FIG. 5: illustrates an elevation view of a drum for applying the label, according to the prior art.

FIG. 4 shows a particular configuration of said embodiment in which the centers C2 and C3 coincide.

The first radius R1 defines the curvature of a circumference along which a contrasting surface 820 of the final shoe 82 develops.

The second radius R2 defines the curvature along which the label guide profile 85 develops.

The third radius R3 defines the curvature of a circumference along which a contrasting surface 810 of the initial shoe 81 develops.

The first radius R1 is preferably smaller than R2.

The second radius R2 is preferably smaller than R3.

In other words, the place of the points of the contrasting surface 810 is in the circle of radius R3 of center C3 and with respect to the center C1 at a distance smaller than the radius R1.

Further the place of the points of the label guide profile 85 is in the circle of radius R2 of center C2 and with respect to the center C1 at a distance smaller than the place of the points of the contrasting surface 810.

In particular, as shown in FIG. 4, said embodiment can provide that at least the second and third radius R2, R3 are not constant, but are the starting point of two curves that are not necessarily circumferential, but more generally two splines along which the label guide profile 85 and the contrasting surface 810 of the initial shoe 81 develop respectively.

In this way, the fact of keeping the distance constant along the entire length of the initial shoe 81 is improved.

Therefore in this configuration the label guide profile 85 is said to be lobed and also the initial shoe 81 is lobed.

A further aspect of the invention may provide that also the first radius R1 is not constant, but is the starting point of a curve that is not necessarily circumferential, but more generally a spline along which the contrasting surface 820 of the final shoe 82 develops.

In accordance with an aspect of the invention in said embodiment, the contrasting surface 810 and/or 820 of the respective initial and final shoes 81, 82 can provide for a lead-in so as to connect with the label guide profile 85.

Thanks to this solution, the function of the transfer drum 8 to accompany guide and retain/push the label 3 in the correct position on the container 4 during the whole application step is further guaranteed.

The labeling machine 1 and/or 10 therefore provides that the adhesion of the label 3 on the container 4 is guaranteed not only by the pressure exerted by the initial shoe 81 on the initial flap 31, but the adhesion is further guaranteed by accompanying and guiding the central portion 33 of the label 3, which therefore adheres to the container 4 not only thanks to the adhesive power of water, but also and above all thanks to the aid of the label guide profile 85 of the transfer drum 8.

Furthermore, the use of the transfer drum 8, with the constructive characteristics described above, contributes to the correct adhesion and application of the label 3 to the container 4 not only at the initial shoe 81, but also along the whole label guide profile 85.

In fact, the possibility of guiding the label 3 during application to the container 4 by means of the transfer drum 8 reduces the detachment problems that can occur using a traditional cylindrical transfer drum 8*a*.

In this way it is possible to realize a labeling machine 1 with adhesion fluid, for example water and/or fluid with low-adhesive components, which manages to achieve high reliability in applying the label 3.

Similarly, it is possible to realize a labeling machine 10 with adhesion fluid, for example degradable glue, which manages to reach high application speeds of the label 3.

The result of the labeling of the type obtained with the labeling machine 1 and/or 10 object of the present invention makes a functional result for the recycling of the container 4 possible, from which the label 3 is easily detachable, without leaving said container 4 contaminated from glue.

Furthermore, the first embodiment represented by the labeling machine 1 allows obtaining a water labeling machine 1 with high reliability of application of the label without limiting the use of labels having reduced heights.

The second embodiment represented by the labeling machine 10, makes it possible to reach high rates that are comparable with the rates of labeling machines that use traditional glues for adhering the label 3 to the container 4 where the rate can be about 40/50000 containers/hour and beyond.

In fact, the possibility of fixing the label 3 securely, even if temporarily, to the container 4 by means of glue, ensures a good adhesion of the label 3, during the application step.

In this way, besides increasing production speed, there are no limits to the use of labels with reduced heights.

An object of the present invention is also to provide a method for labeling containers 4 by means of a preferably continuous film strip 2 suitably cut into labels 3 which provides for the following steps:

a) distributing adhesion fluid on the surface of the container 4 on which the label 3 is to be applied and/or on the surface of the label 3 itself;

b) transferring the label 3 on the container 4 by means of application means 800, so that the label 3 and/or the container 4 is guided and held in position one towards the other, or vice versa, operating along substantially the entire extension of the area in which the respective faces (30) of said label 3 and the body of said container 4 are mutually facing;

c) a further possible step is that of superimposing and fixing the final flap 32 on the initial flap 31 of the label 3.

Said labeling method can envisages said step c) being preceded by a further step adapted to distribute a layer of glue on the final flap 32 for fixing it on the initial flap 31 of the label 3.

The application means 800, used in said labeling method, can comprise the transfer drum 8 according to the constructive form described above.

Therefore the labeling machine 1 and/or 10, operating according to the method described above or realized in the embodiments envisaged, allows achieving high reliability and labeling speed.

Further in this way, in addition to increasing reliability and production speed, there are no limits to the use of labels with reduced heights.

The object of the invention is also a labeling method for labeling containers 4 by means of a continuous film strip 2 suitably cut into labels 3, wherein it is contemplated to fix the label 3 to the container 4 by means of an adhesion fluid adapted to adhere the label 3 to the container 4, characterized in that, as adhesion fluid, a dissolvable type fluid is used within a determined time sufficient to guarantee the function of applying the label 3 to the container 4, and/or removable through the use of suitable removal means.

The object of the invention is also an article of the container type 4, in particular a container 4 with label 3 wherein the fixing of the label 3 to the container 4 takes place by means of an adhesion fluid of the dissolvable type within a determined time sufficient to guarantee the function of applying the label 3 to the container 4, and/or removable through the use of suitable removal means.

Thanks to this solution it is possible to realize a labeled container 4 which simplifies and allows the complete recycling of the same container 4.

In accordance with the aforementioned purposes, namely to allow complete recycling of the container 4, the invention further relates to a treatment method for recycling the container 4, labeled as described above, which provides for:

Washing the container 4 with liquid preferably water to remove and/or deactivate the adhesion fluid for detaching the label 3 from the container 4;

Further said method can provide for the steps of:

Cutting the label 3

Separating the label 3 from the container 4.

By washing the container 4, any residue of adhesive components of the adhesion fluid is further deactivated/eliminated.

Likewise the object of the invention is the related plant for the recycling treatment of the container 4, labeled as described above, which comprises devices configured to wet the containers 4 with liquid preferably water adapted to deactivate the adhesion fluid for detaching the label 3 from the container 4 and comprising cutting devices configured for cutting the label 3 and for carrying out the separation of the label 3 from the container 4.

It is understood however that what is described above has a value of non-limiting example, therefore, possible variants of detail that may be necessary for technical and/or functional reasons, are considered from now falling within the same protective scope defined by the claims indicated below.

The invention claimed is:

1. Labeling machine (1, 10) for labeling containers (4) by means of a continuous film strip (2) cut into labels (3), configured for fixing the label (3) to the container (4) by means of an adhesion fluid adapted to adhere the label (3) to the container (4), said adhesion fluid is dissolvable within a given time sufficient to guarantee application of the label (3) to the container (4) and/or removable by removal means, said labeling machine (1, 10) comprising:

advancing means (9) of the container (4);

application means (800) comprising a transfer drum (8), rotatable around an axis (Z), which operate synchronized with rotation of advancing means (9) during the application of the label (3) to the container (4), said transfer drum (8) which provides at least one application area (80) configured to retain the label (3) and apply the label to the container (4), said application area (80) in turn comprising a label guide profile (85), on which the label (3) rests, configured to keep a distance (D) between the container (4) and the label guide profile (85) constant throughout application of the label, wherein the at least one application area (80) further comprises an initial shoe (81) and a final shoe (82) located at ends of, and protrude from, the label guide profile (85), said shoes (81, 82) being configured to hold in support an initial flap (31) and a final flap (32) of the label (3), respectively, being placed at a first point of application of the label (3) to the container (4) and an overlap point, said shoes (81, 82) defining an offset (H) from the label guide profile (85) which is different between the initial shoe (81) and the final shoe (82), wherein the final shoe (82) protrudes from the guide profile beyond an extent of the initial shoe (81), the final (82) shoe comprises a respective contrasting surface (820) which follows a curvature of a circumference defined by a first radius (R1) extending from a first center (C1) located on the axis (Z) of the transfer drum (8); and means for adhering the label (3) to the container (4) comprising fluid distribution means (6) for distributing said adhesion fluid, wherein said distribution means (6) are configured to distribute the adhesion fluid on a body portion of the container (4) along substantially an entire application surface in order to adhere the label (3) to the container (4).

2. The labeling machine (1) according to claim 1, wherein the adhesion fluid comprises, or consists of water.

3. The labeling machine (10) according to claim 1, wherein the adhesion fluid comprises, or consists of, a degradable type glue.

4. The labeling machine (10) according to claim 1, wherein the adhesion fluid comprises, or consists of, a low-tack fluid.

5. The labeling machine according to claim 1, wherein said fluid distribution means (6) are also configured to distribute said adhesion fluid on an initial flap (31) of the label (3).

6. The labeling machine according to claim 1, wherein means for adhering the label (3) to the container (4) comprise said application means (800) adapted to guide said label (3) so as to dispose the label at or near a surface of said container (4) one towards the other, operating along substantially an entire extension of an area in which the respective faces (30) of said label (3) and a body of said container (4) are mutually facing.

7. The labeling machine according to claim 1, wherein said distance (D) between the label guide profile (85) and the container (4) is less than 2 millimeters, during the application cycle of the label (3).

8. The labeling machine according to claim 1, wherein the transfer drum (8) can provide multiple application areas (80) according to the number of labels to be applied, and the size of the advancing means (9).

9. The labeling machine according to claim 1, wherein said shoes (81, 82) are made of deformable material and/or protrude from the label guide profile (85) by a variable offset (H) so as to interfere with the container (4) to exert a correct pressure respectively for the application of the initial flap (31) of the label (3) to the container (4) and to close the label (3) by fixing the final flap (32) on the initial flap (31).

10. The labeling machine according to claim 1, wherein the label guide profile (85) follows a curvature of a spline, with variable radius and center configured to maintain the distance (D) between a portion of the label guide profile (85) and the container (4) constant and minimum during the application of the label (3).

* * * * *